United States Patent [19]

Pitel

[11] 4,437,043

[45] Mar. 13, 1984

[54] LIGHTING CONTROL FOR HIGH INTENSITY DISCHARGE LAMP

[75] Inventor: Ira J. Pitel, Morristown, N.J.

[73] Assignee: Cornell-Dubilier Electric Corporation, Newark, N.J.

[21] Appl. No.: 443,243

[22] Filed: Nov. 22, 1982

[51] Int. Cl.[3] ..... H05B 41/392

[52] U.S. Cl. ..... 315/308; 315/199; 315/151; 315/311; 315/DIG. 4

[58] Field of Search ..... 315/194, 199, 283, 307, 315/308, 310, 311, DIG. 4, DIG. 7, 151, 156, 158

[56] References Cited

U.S. PATENT DOCUMENTS 4,320,326 3/1982 Banziger ..... 315/199 X 4,356,433 10/1982 Linden ..... 315/308

OTHER PUBLICATIONS

Kappenhagen, *Phase-Controlled Ballast Circuit Operates All High-Pressure Arc Lamps,* Westinghouse Engineer, Jan. 1971, vol. 31, No. 1, pp. 25-29.

*Primary Examiner*—Eugene R. LaRoche

*Attorney, Agent, or Firm*—Ronald R. Stanley

[57] ABSTRACT

The invention is directed to a circuit and method for effectively controlling the output illumination of high intensity discharge lamps. Electronic circuitry monitors the lamp current, lamp voltage and lighting output to result in a maintained lighting level while providing increased efficiency and energy conservation. The use of electronic controls eliminates the complicated magnetic circuitry found to be necessary for previous methods of control.

14 Claims, 6 Drawing Figures

LIGHTING CONTROL FOR HIGH INTENSITY DISCHARGE LAMP

BACKGROUND OF THE INVENTION

This invention relates to circuitry for controlling the output level of high intensity discharge lamps and, more particularly, to circuitry having load-side control using a controlled impedance coupled between a transformer primary winding and the high intensity discharge lamp. The controlled impedance, and a circuit rendering the controlled impedance conductive for predetermined periods of time, control energization of the lamp and therefore the lighting output.

High intensity discharge (HID) lamps are used in conjunction with a ballast and include capacitors and complex magnetic circuits to limit lamp current. Of the various types of ballasts available for use, high intensity discharge lamp systems most frequently are used in conjunction with lead type ballasts. Lead type ballasts use negative magnetic properties to their advantage. Magnetization current is used to improve power factor correction and core saturation is used to regulate lamp current. An additional advantage is gained in that both the magnetization current and core saturation factors result in minimizing the size and cost of the ballast.

While high intensity discharge lamps using mercury or metal halide may be grouped together as conventional discharge fixtures, high pressure sodium (HPS) lamps are effectively in a separate group requiring larger ballasts due to lamp voltage increasing with hours of operation. Furthermore, HPS lamps require a relatively large voltage to initiate the arc. The ballast in the case of an HPS lamp circuit must, therefore, provide power regulation, as well as the starting voltage.

Numerous techniques have been proposed for controlling the output illumination level of gas discharge lamps. U.S. Pat. No. 4,197,485 provides lamp dimming in response to selected illumination levels or varying secondary sources such as natural sunlight. U.S. Pat. Nos. 4,207,497 and 4,207,498 convert line frequency to a higher frequency in an effort to increase the efficiency of the unit.

The assignee of the present patent application has three pending U.S. patent applications on lighting controls for fluorescent lamps. The first two of three applications, Ser. Nos. 286,770 filed July 27, 1981 and 309,460 filed Oct. 7, 1981, concern control circuits functioning with standard magnetic ballasts to control the output illumination level of gas discharge lamps. In order to accommodate a multitude of magnetic ballasts, the control circuits each include a circulating inductor coupled in parallel with a controlled impedance such that current is provided to the lamps during a portion of the AC signal when the controlled impedance would be nonconductive. The third application, Ser. No. 338,340 filed Jan. 11, 1982, provides similarly functioning control circuitry in conjunction with an integral ballast and is intended for replacement of existing ballasts or new manufacture.

SUMMARY OF THE INVENTION

This invention is directed to an apparatus and method of controlling the output illumination level of high intensity discharge (HID) lamps, such as mercury, sodium and metal halide vapors. The present invention is directed at a simple, yet efficient method for illumination control of high intensity discharge lamps operating at line frequency. Control of illumination is provided by a timed interval controlled impedance, coupled between the primary winding of a magnetic ballast and the lamp. A current path is maintained between the power source and the lamp during the portion of the AC signal in which the controlled impedance is in a substantially nonconductive state.

The present invention provides a high intensity discharge lamp control unit which electronically regulates lamp power and reduces the size of the magnetics necessary. The electronic circuitry of this invention enables regulation of light output to compensate for lumen maintenance, a function made necessary by degradation of light output over hours of operation which is a phenomena associated with gaseous discharge lamps.

DETAILED DESCRIPTION OF THE PREFERRED EMBODIMENT

Figure 1:
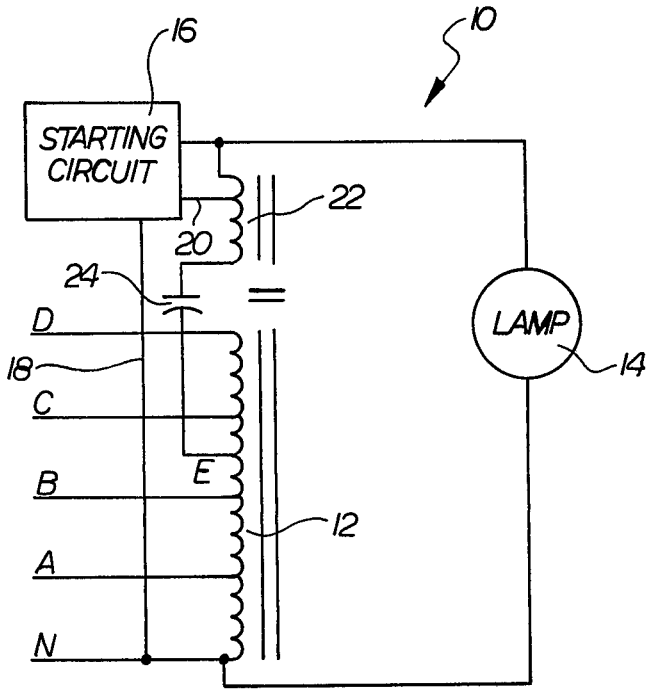
FIG. 1 illustrates a conventional magnetic ballast arrangement for a single high intensity discharge lamp.

Referring to the drawings, FIG. 1 represents a circuit diagram for a high intensity discharge lamp with a conventional ballast, specifically, a high pressure sodium (HPS) lighting system. A ballast 12 has primary input leads for AC power sources of various voltages. Depending upon the power source available, one lead of the source would be connected to the neutral connection, indicated at numeral N, while the other lead would be connected at input lead A for a 120 volt source, input B for a 208 volt source, input C for a 240 volt source and input D for a 277 volt source. An HPS lamp 14 has one terminal connected directly to the neutral lead of ballast 12 and the remaining lead connected to a starting circuit 16.

The characteristics of an HPS lamp require from 2.5 to 5.0 kilovolts in order to initiate the arc. Since this starting voltage far exceeds the operating voltage required for the lamp, starting circuit 16 is provided specifically for the purpose of initiating the arc by supplying the required start-up voltage. Starting circuits for HPS lamps are well known in the prior art, and any one of a number of such starting circuits may be used in conjunction with the circuitry shown in FIG. 1. Power for the starting circuit is provided by a first lead 18 connected to the N lead of ballast 12. A second lead 20 from starting circuit 16 is connected to a regulated power source for lamp 14. This regulated power source is provided by an inductor 22 and capacitor 24 in electrical series between lead E of transformer 12 and the second terminal of lamp 14. Inductor 22 and capacitor 24 provide a power regulating impedance for control of the current supplied to lamp 14.

Figure 2:
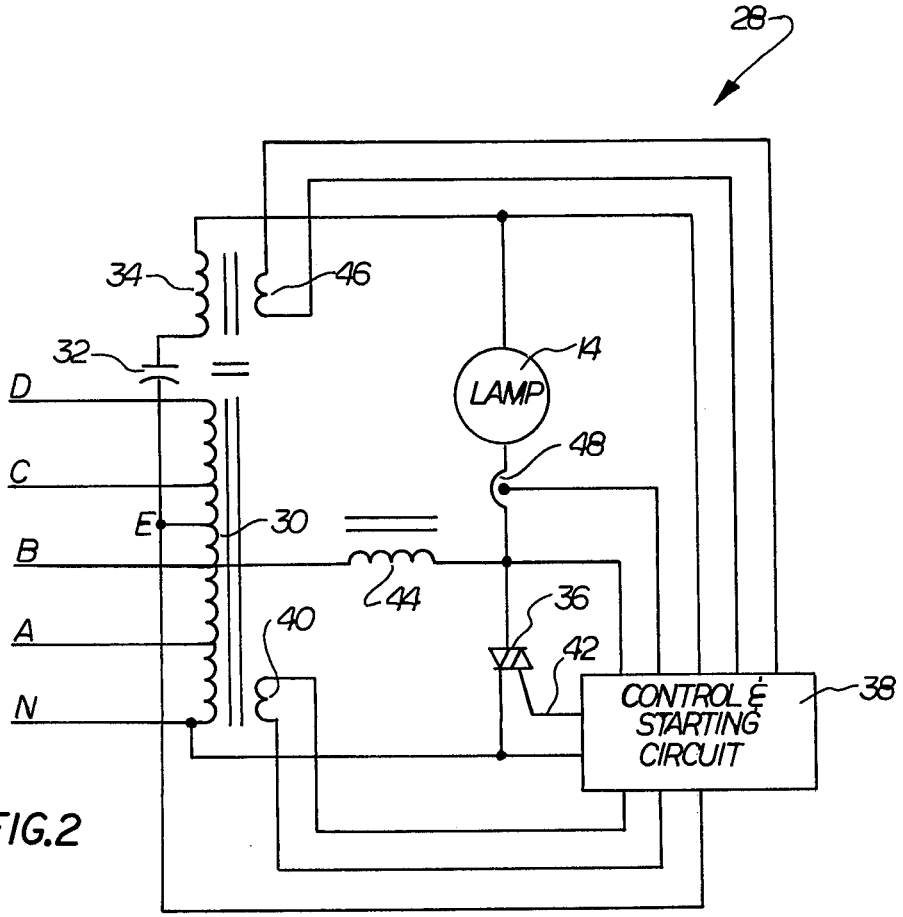
FIG. 2 illustrates one embodiment of the illumination control system of the present invention.

FIG. 2 illustrates one embodiment of a high intensity discharge lighting control circuit 28 of the present invention. To facilitate illustration, a high pressure sodium (HPS) lamp is used as a specific embodiment of the high intensity discharge lamp, noting, however, that the applicability of the invention to other high intensity discharge lamps including mercury vapor and metal halide should be clearly understood. While only one lamp is shown in the embodiment, the application of the invention is easily expandable to more than one lamp.

The operation of the lighting control apparatus of the present invention will be explained in sufficient detail herein; however, it should be noted that U.S. patent applications, Ser. Nos. 286,770 filed July 27, 1981; 309,260 filed Oct. 7, 1981; and 338,340 filed Jan. 11, 1982, all assigned to the same assignee as the present invention, provide detailed descriptions of operations of modular lighting control systems similar to that of the present invention. While these above noted applications concern modular controlled lighting arrangements intended for use in conjunction with fluorescent lighting lamps, the present invention is more directly concerned with high intensity discharge lighting arrangements.

In FIG. 2, a magnetic ballast 30 includes primary input leads N for neutral, A for 120 volts AC, B for 208 volts AC, C for 240 volts AC and D for 277 volts AC. Depending upon the particular power source available for use in connection of the lamp circuit, the neutral lead and one of the power leads A through D would be connected to the source. A capacitor 32 and transformer winding 34 provide power regulation for supplying one lead of lamp 14. This power regulation is consistent with the prior art as explained in FIG. 1. The other lead of lamp 14 is connected to the neutral lead of ballast 30 through a controlled impedance 36. Thus, the conduction path of the controlled impedance is in series relationship between lamp 14 and lead N.

Control of power delivered to the high intensity discharge lamp is accomplished through a control and starting circuit 38. A secondary winding 40 on ballast 30 provides a power source for the control and starting circuit. Winding 40 has a smaller number of turns than the primary windings of the ballast in order to achieve a step-down of voltage. In a 120 volt system, winding 40 preferably provides about 18 volts AC between its output leads.

Control circuit 38 provides a time duration controlled drive signal to a control electrode 42 of impedance 36. In practice, control circuit 38 is effective to drive impedance 36 into or from a conductive state during a controlled portion of each half-cycle of the AC line voltage. The controlled impedance is preferably a controlled switch, such as, for example, a TRIAC, which can provide either an open circuit or a short circuit across its main conductive path, depending upon the control signal at the control electrode.

It will be appreciated that the state of controlled impedance 36 (conductive or non-conductive) will determine whether lamp current flow is through the controlled impedance or not. When controlled impedance 36 is in its conductive state, there exists a series circuit between the ballast and the lamp applying an operating current to the lamp. When the impedance is in a non-conductive state, heating current only is supplied to the lamp by means of a circulating inductor 44 connected between the lead of lamp 14 and the primary of ballast 30.

A secondary winding 46 associated with winding 34 provides power to the starting portion of control and starting circuit 38 to initiate operation of the lamp.

In the absence of an activating signal at control electrode 42, controlled impedance 36 presents a very high impedance between the primary of the ballast and the lamp. When an activating signal is applied at the control electrode, the controlled impedance turns on, thereby presenting a low impedance (i.e., it becomes conductive) between the primary and the lamp. Thereafter, controlled impedance 36 remains conductive until the current flowing therethrough fails to exceed a predetermined extinguishing current. The controlled impedance is chosen to conduct in both directions upon being triggered; however, the impedance will turn off during each cycle of an AC signal due to the current flow dropping below the extinguishing current when the AC signal changes direction. In the preferred embodiment, controlled impedance 36 is retriggered during each half-cycle of the power signal. By varying the delay before retriggering occurs, it is possible to control the proportion of each half-cycle over which controlled impedance 36 conducts and thereby the overall power delivered to the lamp.

Inductive windings 30, 34, 40, 44 and 46 can be constructed on a common core separated by magnetic shunts in order to minimize the total ballast size. By combining all of the magnetic windings, a 25 to 50% reduction in magnetic size is possible.

Figure 3:
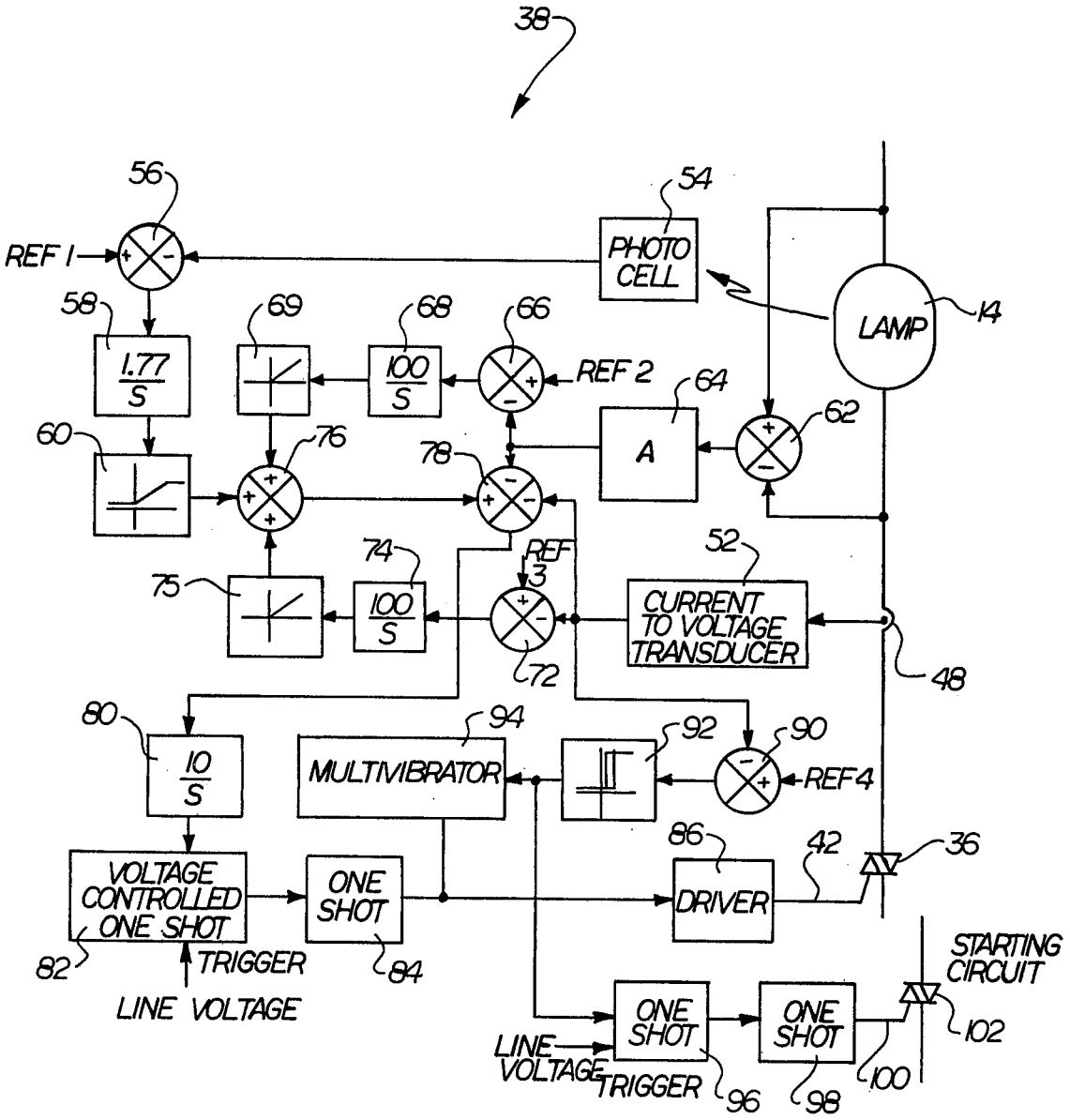
FIG. 3 illustrates, in block diagram format, a control circuit of the present invention.

Referring to FIG. 3, there is shown in block diagram format the current regulating functions of control and starting circuit 38. Broadly stated, the control scheme consists of three feedback loops, a first loop monitoring lamp current, a second loop monitoring lamp voltage, and a third loop monitoring lighting intensity. A current monitoring device 48 between controlled impedance 36 and lamp 14 samples the current through the main conduction path of the controlled impedance in the first feedback loop. The lamp current is converted to a voltage by a current-to-voltage transducer 52 resulting in a voltage proportional to the current monitored.

The output of current-to-voltage transducer 52 is compared at a comparator 72 to a reference signal, REF 3, representing the minimum current value through the conduction path of controlled impedance 36. The output signal of comparator 72 is connected to an integrator 74 which functions to attenuate responses caused by fluctuations in the current value due to the operation of the controlled impedance. A signal limiter 75 assures that the output of integrator 74 remains within a predetermined range of values. A first control signal is the resultant output of limiter 75.

In the second feedback loop the voltage occurring across lamp 14 is determined by differentially measuring the voltage across the lamp through use of a comparator 62. The output signal from comparator 62 is amplified at amplifier 64 with this output connected to a comparator 66 for comparison to a reference signal, REF 2, representing a minimum voltage value. The output signal of comparator 66 is connected to an integrator 68 which functions to attenuate responses caused by fluctuations in the lamp voltage. A signal limiter 69 assures that the output of integrator 68 remains within a predetermined range of values. A second control signal is the resultant output of limiter 69.

The third feedback loop compares the output of a photocell 54 to a reference signal. As illustrated in FIG. 3, photocell 54 is positioned to intercept a portion of the irradiance from high intensity discharge lamp 14 and thus provide a signal which is proportional to the output illumination level of the lamp and the ambient light level in the immediate vicinity.

A comparator 56 compares the output of photocell 54 to a reference signal REF 1 which may be established either internally or externally (not shown). The output signal of comparator 56 is connected to an integrator 58 which functions to attenuate responses caused by ambient lighting perturbations, or the like. In order to restrict the output signal of integrator 58 to boundaries within the dynamic range of a given lamp configuration, the output of integrator 58 is connected to a signal limiter 60. A third control signal is the resultant output of signal limiter 60.

The outputs of signal limiters 60, 69 and 75 are connected to a summing amplifier 76 to provide an output proportional to the amount of light developed by lamp 14 and observed by photocell 54. First and second control loop output signals add little to the third loop signal under normal circumstances, but provide a stabilizing effect at instances of low light output. The output from summing amplifier 76 and the first and second control signals produced by the feedback loops are connected to a comparator 78 producing a differential error signal. If the first and second control signals balance the third control signal (amplifier 76), the error signal would be equivalent to zero and no correction is necessary. Any other combination of the control signals would, of course, result in a value for the error signal.

This differential error signal is connected to an integrator 80 and, in turn, to a voltage controlled one-shot 82. Voltage controlled one-shot 82 is triggered by the line voltage and further operates a one-shot 84. One-shots 82 and 84 provide signal shaping and activate a driver 86 which provides the control signal for electrode 42 of the controlled impedance. The output of integrator 80 advances the timing of one-shot 82 which, in turn, advances the firing of controlled impedance 36.

The operation of the control circuitry can best be illustrated by assuming that there is a positive differential error signal. This positive error causes the output of integrator 80 to increase with time and thus advance the timing of voltage controlled one-shot 82. Controlled impedance 36 therefore triggers earlier in the voltage cycle, increasing the current fed to lamp 14. When the differential error signal from comparator 78 approaches zero, the output of integrator means 80 ceases increasing and the firing of the controlled impedance remains unchanged.

As noted above, circuit 38 also includes a starting circuit for lamp 14. The details of this starting circuit may also be understood with the aid of FIG. 3. The output signal from current-to-voltage transducer 52 and a reference signal, REF 4, representing the presence of lamp current, are connected to a comparator 90. Comparator 90 is connected to a signal limiter 92 which results in an output when lamp 14 is not illuminated. This output signal, representing non-illumination of lamp 14, is used for two purposes. First, through a multi-vibrator 94, driver 86 is operated and thus controlled impedance 36 conducts current through the lamp. Second, the output of signal limiter 92 is presented to a one-shot 96, triggered by the line voltage. When one-shot 96 operates, another one-shot 98 is in turn activated to result in a control signal 100 rendering a switch 102 active for a short period at the peak of the line half-cycles. Lamp 14 is then excited by the starting voltage presented from winding 46 as noted above.

Figure 4:
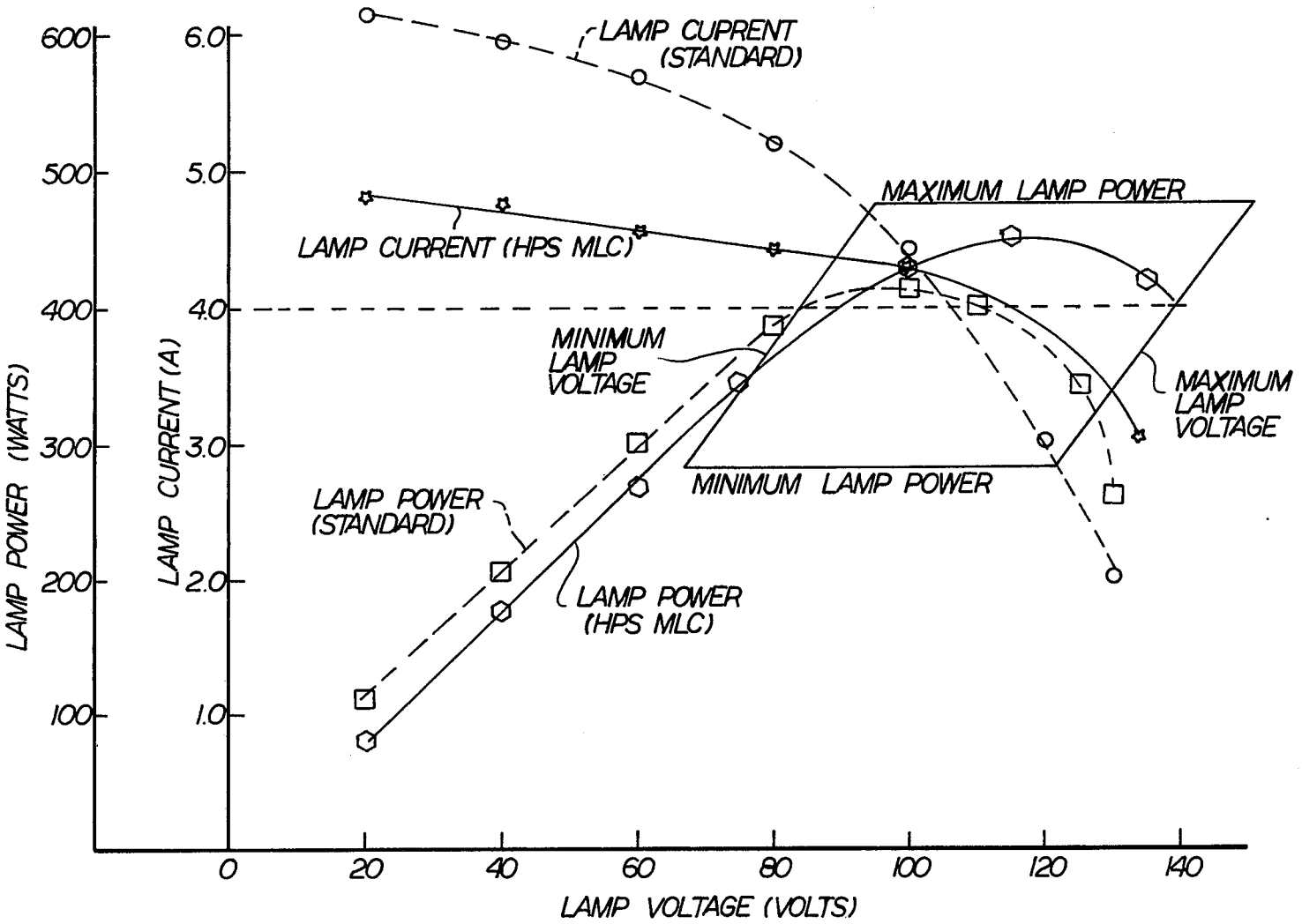
FIG. 4 represents lamp voltage versus lamp current and lamp power for a high intensity discharge lamp with standard ballast and a high pressure sodium lamp with the control circuit of the present invention.

A comparison of the operating characteristics of a high intensity discharge lamp with a standard ballast to the samp lamp with the modular lighting control of the present invention is depicted in FIG. 4 wherein lamp voltage is shown in relation to lamp current and lamp power for both arrangements. The lamp with standard ballast is shown in dashed lines while the lamp with modular lighting control is shown in solid lines. A trapezoid overlay, indicated at reference numeral T, represents the industry standard used in defining lamp power for high intensity discharge lamps. With the upper line of the trapezoid representing maximum lamp power, the lower line representing minimum lamp power, the left boundary indicating minimum lamp voltage and the right boundary indicating maximum lamp voltage, it can be seen that both ballasts, conventional and modular lighting control, meet the requirements of the industry.

Figure 5:
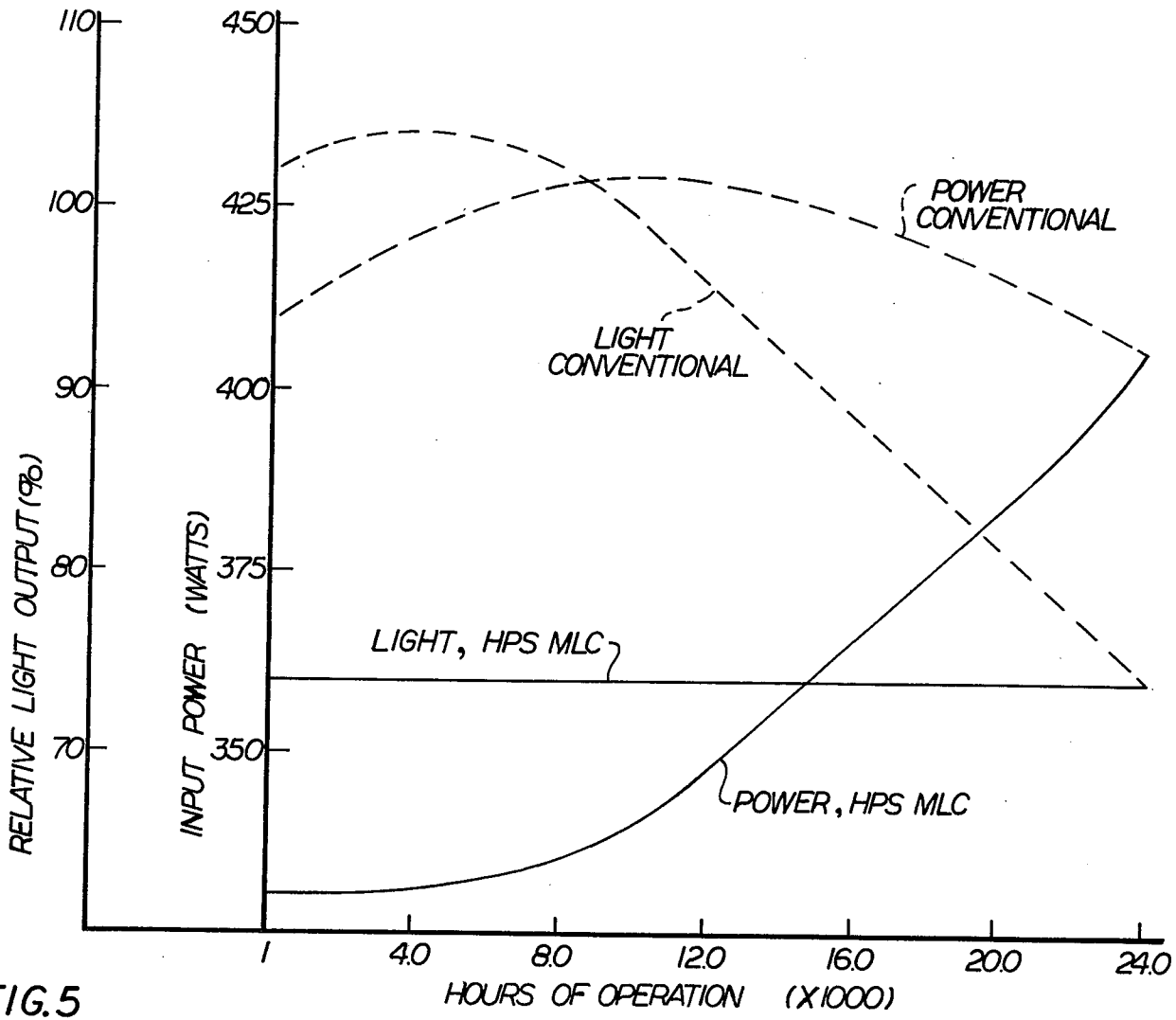
FIG. 5 represents the hours of operation versus input power and relative light output for a high intensity discharge lamp with a conventional ballast and a high pressure sodium lamp with the control circuit of the present invention; and, FIG. 6 illustrates a circuit diagram for a specific embodiment of the invention.

The energy saving abilities of the present invention are more dramatically expressed with the aid of FIG. 5 wherein the input power required and the relative light output are represented with respect to hours of operation. The characteristics for a standard ballast are shown in dashed lines, while the modular lighting control (MLC) of the present invention is depicted by solid lines. The goal of MLC circuitry is to stabilize the relative light output from lighting systems, and FIG. 5 indicates the realization of this goal. The light output for the MLC lighting circuit can be seen to be a straight line parallel to the horizontal. The level of the light in the case of the MLC circuit could be set at any value between 25 and 100% of full output rated value for the lighting fixture.

A comparison of the MLC light to the conventional ballast light indicates the marked improvement in performance of the light. More importantly, the power consumed by the MLC light system can be seen to display a marked improvement over the conventional ballast system. After an extended period of time, the power used by the MLC lighting system will equal the power supplied to the conventional system; however, the MLC system provides a marked advantage over the conventional ballast prior thereto and particularly at start-up.

As a result of the lighting control of the present invention, the light output for a high intensity discharge lamp can be set and maintained at or below a level possible with conventional ballasts. Through lumen maintenance and task lighting, considerable energy is conserved by use of the present invention. Troublesome analog multipliers are avoided in limiting maximum lamp power through an unique yet simple technique. And, while the power used by the lamp as a result of the present invention is lowered, lamp current and voltage are limited to assure arc stability and continuous lighting at a sufficient, yet stable level.

Figure 6:
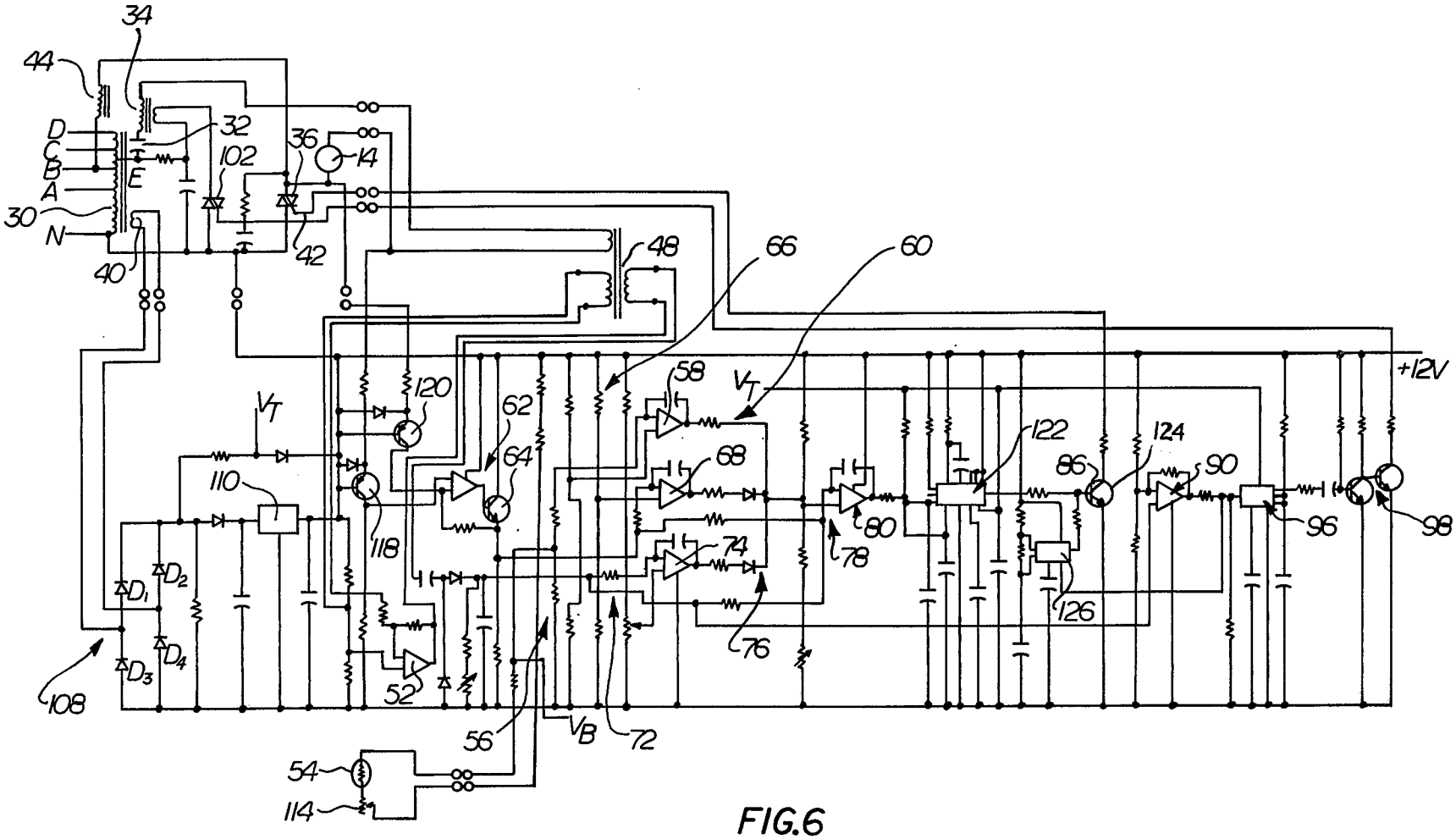

To assist one skilled in the art in the practice of the present invention, FIG. 6 illustrates a circuit diagram for a specific embodiment with a high pressure sodium (HPS) lamp. Power for the control circuit is derived from winding 40 being connected to a diode bridge 108 including diodes D1 through D4. The bridge provides rectified power and 60 hertz synchronization for the one-shots discussed above. Integrated circuit 110 comprises a series regulator maintaining a given voltage for the control circuit supply, typically about 10 volts. The design of the power supply itself is not unique and any one of a number of designs may be substituted.

The first control loop, concerned with the current supplied to lamp 14, includes a current sensing transformer 48, operating as a current monitor, which provides a signal to an operational amplifier 52, operating as a current-to-voltage transducer. Transducer 52 has its output compared to a minimum value for lamp current in the form of a reference signal (REF 3) at comparator 72. A resistor network providing the comparator enables REF 3 to be set by the values picked for the resistors in the network.

The second control loop, concerned with the voltage across lamp 14, utilizes first and second voltage pick-up circuits, 118 and 120, respectively, to determine the voltage across the lamp. Outputs of these voltage pick-up circuits are combined through a summing amplifier 62 and amplified at transistor circuit 64. The output of amplifier 64 is compared to a reference voltage (REF 2) by means of comparator and integrator 68. The value of the reference REF 2 is determined by the values of the resistors in network 66.

The third control loop begins with photocell 54 being placed in a resistor bridge 56. REF 1 for bridge 56 may be set mechanically with a shutter mechanism covering the photocell from irradiation by the lamp or electronically by adjusting a variable resistor 114. The output signal of integrator 58 is applied to a resistive network which comprises a signal limiter 60, the upper and lower boundaries of which are set by the values of the resistors.

The output signals from the first, second and third loops are combined by summing means 78 comprising a resistor network, then connected to integrator 80 comprising a capacitor and an operational amplifier. An integrated circuit 122 provides one-shots 82 and 84. One-shot 82 is triggered by the zero crossing of the line voltage and controlled by the output of integrator 80. One-shot 84 is in turn triggered by the trailing edge of the output of one-shot 82 and has its output connected to the base of a transistor 124 which is included in driver 86 used to trigger control electrode 42 of the controlled impedance, shown as TRIAC 36.

The first control loop is also used to operate the starting circuit. REF 4, indicating the presence of any current through the lamp, is compared to the output of transducer 52 by comparator 90. If no current is present through the lamp, the starting circuit must be energized to initiate lighting. In this case, multivibrator 94, constructed with the aid of integrated circuit 126, forces full conduction of TRIAC 36 through driver 86 and operates one-shots 96 and 98 to cause TRIAC 102 to conduct and generate high voltage pulses at the line voltage peaks. Both of these conditions are required in order to initially energize lamp 14 and cause lighting thereof.

While considerable emphasis has been placed herein on a preferred embodiment of the invention and the specific structure and structural interrelationship of the component parts thereof, it will be readily apparent that many changes can be made in the embodiment herein illustrated and described without departing from the principles of the invention. Accordingly, it is to be distinctly understood that the foregoing descriptive matter is to be interpreted as merely illustrative of the invention and not as a limitation.

What is claimed is:

1. A control circuit for regulating light output of high intensity discharge lamps comprising:

a magnetic ballast providing electrical power for at least one high intensity lamp;

a controlled impedance coupled between said ballast and said lamp;

circuit means for controlling a period of conduction for said controlled impedance;

said circuit means including means combining signals proportional to a current through said lamp, a voltage across said lamp and an output lighting level of said lamp; and current conduction means for providing a current path when said controlled impedance is not in a period of conduction.

2. The control circuit according to claim 1 wherein said magnetic ballast includes magnetic windings directly connected to said circuit means.

3. The control circuit according to claim 1 wherein said circuit means includes photodetection means for monitoring output lighting of said lamp and means for providing said signal proportional to the output lighting level.

4. The control circuit according to claim 3 wherein said circuit means further includes current-to-voltage transducer means for deriving said signal proportional to the current through said lamp.

5. The control circuit according to claim 4 wherein said circuit means further includes a differential amplifier for deriving said signal proportional to the voltage across said lamp.

6. The control circuit according to claim 1 wherein said current conduction means includes an inductor having one terminal connected between said lamp and said controlled impedance.

7. In a lighting system for at least one high intensity discharge lamp, a method of controlling the illumination of said lamp comprising the following steps:

connecting an AC power source to a primary winding of a magnetic ballast;

providing a controlled impedance in electrical series with said high intensity lamp across a secondary winding of said magnetic ballast;

controlling conduction of said controlled impedance by combining signals proportional to a current through said lamp, a voltage across said lamp and an output lighting level of said lamp; and providing a current path with a current conduction means when said circuit means does not cause said controlled impedance to conduct.

8. The method according to claim 7 further comprising the step of:

providing said circuit means with operating power from secondary windings of said magnetic ballast.

9. The method according to claim 7 wherein controlling conduction of said controlled impedance includes:

providing said output lighting level with photodetection means producing said signal proportional to said output lighting level;

deriving said signal proportional to the current through said lamp through current-to-voltage transducer means;

deriving said signal proportional to the voltage across said lamp through a differential amplifier; and comparing the sum of said current and voltage signals to said output lighting level signal.

10. The method according to claim 7 wherein providing a current path further includes:

connecting a first terminal of an inductor to the AC power source; and connecting a second terminal of said inductor intermediate said lamp and controlled impedance.

11. In a system for controlling the output illumination of at least one high intensity discharge lamp, including an AC power source, a magnetic ballast for powering said lamp and a starter circuit for initiating lighting of said lamp, the improvement comprising:

a controlled impedance electrically coupled between said magnetic ballast and said lamp;

circuit means for controlling a period of conduction for said controlled impedance;

said circuit means including means for providing a first signal proportional to an output lighting level of said lamp, means for providing a second signal proportional to the current through said lamp, means for providing a third signal proportional to the voltage across said lamp, and means for comparing said first signal to the second and third signals; and current conduction means electrically connected between said AC power source and said lamp for providing a current path said when controlled impedance is not in a period of conduction.

12. The improvement according to claim 11 wherein said means providing said first signal includes photodetection means for monitoring said output lighting level.

13. The improvement according to claim 12 wherein said means providing said second signal includes a transducer.

14. The improvement according to claim 13 wherein said means providing said third signal includes a differential amplifier and voltage pick-up means for detecting voltage levels.

* * * * *